United States Patent [19]

Ishizuka et al.

[11] Patent Number: 4,599,539

[45] Date of Patent: Jul. 8, 1986

[54] RADIATION IMAGE STORAGE PANEL

[75] Inventors: Akio Ishizuka, Fujinomiya; Hisashi Yamazaki; Kikuo Yamazaki, both of Kaisei, all of Japan

[73] Assignee: Fuji Photo Film Co., Ltd., Kanagawa, Japan

[21] Appl. No.: 610,575

[22] Filed: May 15, 1984

[30] Foreign Application Priority Data

May 16, 1983 [JP] Japan ..... 58-86228
May 4, 1984 [JP] Japan ..... 59-89614

[51] Int. Cl.[4] ..... H05B 33/20; H01J 31/52

[52] U.S. Cl. ..... 313/525; 313/502; 313/503; 252/301.36

[58] Field of Search ..... 313/502, 525, 543, 586, 313/509, 503; 252/301.36; 428/416, 423.7

[56] References Cited

U.S. PATENT DOCUMENTS 3,461,075 8/1969 Manson et al. ..... 313/525 X
3,710,181 1/1973 Tanaka et al. ..... 313/525 X

*Primary Examiner*—David K. Moore
*Assistant Examiner*—K. Wieder
*Attorney, Agent, or Firm*—Gerald J. Ferguson

[57] ABSTRACT

A radiation image storage panel comprising a support and a phosphor layer provided thereon which comprises a binder and a stimulable phosphor dispersed therein, characterized in that said binder contains a (meth)acrylic copolymer in the amount of 5–100% by weight, which has repeating units represented by the formulas (I), (II) and (III):

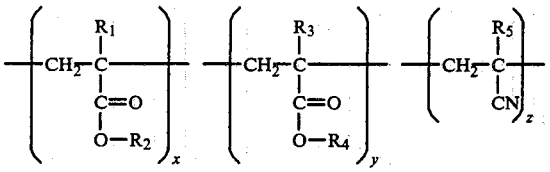

(I) (II) (III)

in which each of $R_1$, $R_3$ and $R_5$ is independently a hydrogen atom or an alkyl group; $R_2$ is a group selected from those consisting of an alkyl group, a cycloalkyl group, an aryl group, a heterocyclic group and an aralkyl group; $R_4$ is a hydrogen atom or an alkyl group and $R_2 \neq R_4$; and x, y and z representing molar percents are numbers satisfying the conditions of $5 \leqq x \leqq 99$, $1 \leqq y+z \leqq 95$ and $x+y+z \geqq 90$. The (meth)acrylic copolymer is preferably employed in combination with a linear polyester having a hydroxyl value in the range of 20–70%.

12 Claims, No Drawings

RADIATION IMAGE STORAGE PANEL

BACKGROUND OF THE INVENTION

1. Field of the Invention

This invention relates to a radiation image storage panel and more particularly, to a radiation image storage panel comprising a support and a phosphor layer provided thereon which comprises a binder and a stimulable phosphor dispersed therein, and optionally a protective film provided on the phosphor layer.

2. Description of Prior Arts

For obtaining a radiation image, there has been conventionally employed a radiography utilizing a combination of a radiographic film having an emulsion layer containing a photosensitive silver salt material and a radiographic intensifying screen.

As a method replacing the above-described radiography, a radiation image recording and reproducing method utilizing a stimulable phosphor as described, for instance, in U.S. Pat. No. 4,239,968 has been recently paid much attention. In the radiation image recording and reproducing method, a radiation image storage panel comprising a stimulable phosphor (i.e., stimulable phosphor sheet) is used, and the method involves steps of causing the stimulable phosphor of the panel to absorb radiation energy having passed through an object or having radiated from an object; exciting the stimulable phosphor with an electromagnetic wave such as visible light and infrared rays (hereinafter referred to as "stimulating rays") to sequentially release the radiation energy stored in the stimulable phosphor as light emission (stimulated emission); photoelectrically converting the emitted light to electric signals; and reproducing a radiation image as a visible image from the electric signals. In the above-described radiation image recording and reproducing method, a radiation image can be obtained with a sufficient amount of information by applying a radiation to the object at considerably smaller dose, as compared with the case of using the conventional radiography. Accordingly, this radiation image recording and reproducing method is of great value especially when the method is used for medical diagnosis.

The radiation image storage panel employed in the above-described radiation image recording and reproducing method has a basic structure comprising a support and a phosphor layer provided on one surface of the support. Further, a transparent protective film is generally provided on the free surface (surface not facing the support) of the phosphor layer to keep the phosphor layer from chemical deterioration or physical shock.

The phosphor layer comprises a binder and stimulable phosphor particles dispersed therein. The stimulable phosphor emits light (stimulated emission) when exposed to an electromagnetic wave such as visible light or infrared rays after having been exposed to a radiation such as X-rays. In the radiation image recording and reproducing method, the radiation having passed through an object or having radiated from an object is absorbed by the phosphor layer of the radiation image storage panel in proportion to the applied radiation dose, and a radiation image of the object is recorded on the radiation image storage panel in the form of a radiation energy-stored image. The radiation energy-stored image can be released as stimulated emission by exciting the panel with an electromagnetic wave such as visible light or infrared rays (stimulating rays). The stimulated emissions is then photoelectrically converted to electric signals, so as to produce a visible image from the electric signals.

It is desired for the radiation image storage panel employed in the radiation image recording and reproducing method to have a high sensitivity and to provide an image of high quality (high sharpness, high graininess, etc.), as well as a radiographic intensifying screen employed in the conventional radiography.

The sharpness of the image in the conventional radiography depends on the spread of the emitted light (spontaneous emission) within the radiographic intensifying screen. In contrast to the conventional radiography, the sharpness of the image in the radiation image recording and reproducing method utilizing a stimulable phosphor does not generally depend on the spread of the light (stimulated emission) emitted by the stimulable phosphor within the radiation image storage panel, but on the spread of stimulating rays within the panel. The reason can be described as follows: Since the radiation energy-stored image recorded on the radiation image storage panel is sequentially detected, the stimulated emission given upon excitation with the stimulating rays for a certain period of time is detected as an output from the area of the panel to be excited therewith for said period. When the stimulating rays are spread through scattering or reflection within the panel, the stimulated emission from the area wider than the area to be excited is detected as the output therefrom.

Accordingly, the quality of the image provided by the radiation image storage panel, particularly the sharpness of the image is generally enhanced by making the thickness of phosphor layer smaller, but in this case the sensitivity thereof is apt to decrease. Therefore, for attaining the enhancement of the image quality without decreasing the sensitivity, it is desired that the mixing ratio between the binder and the stimulable phosphor (binder/stimulable phosphor) in the phosphor layer is made smaller so as to give a phosphor layer containing the stimulable phosphor in a large amount.

The radiation image storage panel is also required to have a sufficient mechanical strength so as not to allow easy separation of the phosphor layer from the support (and from the protective film in the case that the protective film is provided on the phosphor layer), when mechanical shocks and mechanical force caused by falling or bending are applied to the panel in the use. Since the radiation image storage panel hardly deteriorates upon exposure to a radiation and an electromagnetic wave ranging from visible light to infrared rays, the panel can be repeatedly employed for a long period of time. Accordingly, it is necessary for the panel in the repeated use not to cause such troubles as the separation between the phosphor layer and support and the separation between the phosphor layer and protective film caused by the mechanical shocks applied in handling of the panel in a procedure of exposure to a radiation, in a procedure of reproducing a radiation image brought about by excitation with an electromagnetic wave after the exposure to the radiation, or in a procedure of erasure of the radiation image information remaining in the panel.

However, the radiation image storage panel has a tendency that the bonding strength between the phosphor layer and the support as well as that between the phosphor layer and protective film decreases as the mixing ratio of the binder of the stimulable phosphor in the phosphor layer decreases, in other words, as the amount of the stimulable phosphor contained therein increases.

For instance, it has been heretofore proposed to employ cellulose derivatives as a binder of phosphor layer of the radiation image storage panel from the viewpoint of dispersibility of the stimulable phosphor in the binder solution (coating solution), but in this case the obtained panel has no mechanical strength enough for preventing easy separation of the phosphor layer from the support. It has been also proposed to employ a polyester resin as the binder of the phosphor layer, but in this case it is difficult to obtain a phosphor layer containing a stimulable phosphor in a large amount.

Further, in the case that a phosphor layer is formed on a support by a conventional coating procedure using the above-mentioned binders, the stimulable phosphor particles are apt to separate from the binder in the drying procedure of the phosphor layer, because the binders have a poor affinity for the stimulable phosphor. As a result, the relatively large amount of phosphor particles gather on the support side of the phoshor layer, and accordingly, the phosphor particles are present in a relatively small amount on the panel surface side of the phosphor layer (or the protective film side, that is, the side which is exposed to stimulating rays and from which the stimulated emission is read out) so as to produce so-called "gathering on surface" of binder. In such radiation image storage panel, especially when the phosphor layer contains the stimulable phosphor in a large amount, the phosphor particles aggregate on the support side of the phosphor layer, whereby the enough bonding strength between the phosphor layer and the support cannot be obtained. In addition, the stimulating rays easily spread on the panel-side surface of the phosphor layer because of the gathering on surface of the binder, so that the quality of the image tends to deteriorate.

On the other hand, in order to enhance the bonding strength between the phosphor layer and protective film in the radiation image storage panel comprising a support, phosphor layer and protective film, it has been proposed to employ the known acrylic resin such as a polyalkyl methacrylate as the binder of the phosphor layer, but there is a tendency that the cracks are produced in the phosphor layer when the mechanical shock such as bending is given to the panel.

SUMMARY OF THE INVENTION

It is a primary object of the present invention to provide a radiation image storage panel having the characteristics to give a image of high sharpness as well as a high mechanical strength, especially a high bonding strength between the support and phosphor layer.

It is another object of the present invention to provide a radiation image storage panel having a high mechanical strength, especially the high bonding strength between the protective film and phosphor layer and a high resistance to bending action, as well as the characteristics to give an image of high sharpness.

The present invention provides a radiation image storage panel comprising a support and a phosphor layer provided thereon which comprises a binder and a stimulable phosphor dispersed therein, characterized in that said binder contains a (meth)acrylic copolymer in the amount of 5–100% by weight, which has repeating units represented by the formulas (I), (II) and (III):

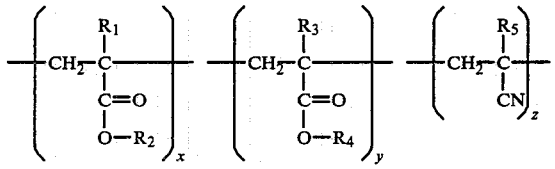

(I) (II) (III)

in which each of $R_1$, $R_3$ and $R_5$ is independently a hydrogen atom or an alkyl group; $R_2$ is a group selected from those consisting of an alkyl group, a cycloalkyl group, an aryl group, a heterocyclic group and an aralkyl group; $R_4$ is a hydrogen atom or an alkyl group and $R_2 \neq R_4$; and x, y and z representing molar percents are numbers satisfying the conditions of $5 \leqq x \leqq 99$, $1 \leqq y+z \leqq 95$ and $x+y+z \geqq 90$.

The present invention further provides a radiation image storage panel comprising a support, a phosphor layer which comprises a binder and a stimulable phosphor dispersed therein, and a protective film, superposed in this order, characterized in that said binder contains a mixture of the above-mentioned (meth)acrylic copolymer having repeating units represented by the above-mentioned formulas (I), (II) and (III) and a linear polyester having a hydroxyl value in the range of 20–70% whose content is not more than 40% by weight of said mixture, in the amount of 60–100% by weight.

DETAILED DESCRIPTION OF THE INVENTION

In the radiation image storage panel of the present invention, both the sharpness of an image provided thereby and the mechanical strength thereof are enhanced by employing a (meth)acrylic copolymer as a binder of a phosphor layer of the panel.

The (meth)acrylic copolymer employable in the present invention has a specifically high affinity for stimulable phosphor particles. Accordingly, a relatively large amount of the stimulable phosphor can be incorporated into a phosphor layer which employs the (meth)acrylic copolymer as a binder. Since the gathering on surface of binder hardly occurs in the phosphor layer containing the stimulable phosphor in a large amount in the case that the above-identified (meth)acrylic copolymer is employed as the binder, the bonding strength between the phosphor layer and support increases. Further, the (meth)acrylic copolymer employed in the invention is so flexible that the radiation image storage panel shows the high resistance to bending (i.e., high flexing resistance) and is accordingly improved in the mechanical strength against the mecanical shocks, bending or the like.

The incorporation of the large amount of stimulable phosphor into the phosphor layer of the radiation image storage panel can bring about the high sharpness of the image provided thereby without decreasing the sensitivity of the panel to a low level. In addition, since the gathering on surface of binder hardly occurs in the phosphor layer, the sharpness of the image provided by the panel of the present invention is predominently enhanced as compared with the conventional panel, even if the mixing ratio between the binder and stimulable phosphor is set to the same as that of the conventional panel.

Further, the radiation image storage panel of the present invention is improved in both the bonding strength between the phosphor layer and protective film and the resistance to bending as well as the sharpness of the image provided thereby, by employing the above-mentioned (meth)acrylic copolymer in combination with a linear polyester having a specific hydroxyl value as the binder of the phosphor layer.

More in detail, the above-mentioned (meth)acrylic copolymer generally has poor compatibility with the normal polyester resin and it has been considered that both resins are hardly employed in combination. However, it has been discovered by the present inventors that the above-mentioned (meth)acrylic copolymer can be employed together with a polyester resin as the binder when the polyester resin is a linear polyester having a hydroxyl value in the range of 20–70%. The radiation image storage panel in which the binder of phosphor layer comprises a mixture of the above-mentioned (meth)acrylic copolymer having the high affinity for phosphor particles and the linear polyester having the good flexibility provides an image of high quality and has a high mechanical strength. In particular, it is generally desired that the bonding strength between the phosphor layer and protective film is not less than 90 g./cm (peel strength, peel angle: 90°), and such peel strength is given to the radiation image storage panel of the present invention. Accordingly, the panel containing the mixture of the (meth)acrylic copolymer and linear polyester as the binder shows the high bonding strength between the phosphor layer and protective film as well as that between the phosphor layer and support, and the higer resistance to bending without decreasing the sharpness of the image.

The radiation image storage panel of the present invention has the advantageous characteristics as described above can be prepared, for instance, in the following manner.

The phosphor layer basically comprises a binder and stimulable phosphor particles dispersed therein.

The binder, that is a characteristic requisite of the present invention, is a (meth)acrylic copolymer having repeating units represented by the formulas (I), (II) and (III):

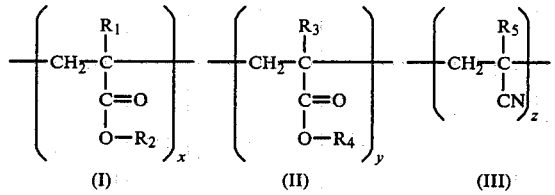

(I) (II) (III)

in which each of $R_1$, $R_3$ and $R_5$ is independently a hydrogen atom or an alkyl group; $R_2$ is a group selected from those consisting of an alkyl group, a cycloalkyl group, an aryl group, a heterocyclic group and an aralkyl group; $R_4$ is a hydrogen atom or an alkyl group and $R_2 \neq R_4$; and x, y and z representing molar percents are numbers satisfying the conditions of $5 \leqq x \leqq 99$, $1 \leqq y+z \leqq 95$ and $x+y+z \geqq 90$.

In the formulas (I), (II) and (III), each of $R_1$, $R_3$ and $R_5$ is a hydrogen atom or an alkyl group, and preferably a hydrogen atom or an alkyl group having 1–6 carbon atoms such as methyl, ethyl, propyl or butyl.

$R_2$ is preferably any one of an alkyl group having 1–20 carbon atoms such as methyl, ethyl, propyl, butyl or hexyl; a cycloalkyl group having 5–12 carbon atoms such as cyclopentyl or cyclohexyl; an aryl group such as phenyl; a heterocyclic group such as pyrizyl; and an aralkyl group having 7–20 carbon atoms such as benzyl, phenylethyl, phenylpropyl, phenylbutyl or naphthylmethyl.

$R_4$ is a hydrogen atom or an alkyl group, and preferably a hydrogen atom or an alkyl group having 1–6 carbon atoms such as methyl, ethyl, propyl, buty or hexyl, provided that $R_4$ is not equal to $R_2$.

From the viewpoint of the affinity for stimulable phosphor particles and the hardness of the resulting layer, the (meth)acrylic copolymer preferably employable for the binder of the radiation image storage panel of the present invention has the above-mentioned formulas (I), (II) and (III), in which x, y and z are numbers satisfying the conditions of $50 \leqq x \leqq 95$, $5 \leqq y+z \leqq 50$, and $x+y+z \geqq 95$. Otherwise, x, y and z may be numbers satisfying the conditions of $70 \leqq x \leqq 95$, $y=0$, $5 \leqq z \leqq 30$, and $x+y+z \geqq 95$, and particularly preferable is $x+y+z=100$.

In the case that the sum of x, y and z is a number less than 100 ($x+y+z<100$) in the formulas, the (meth)acrylic copolymer contains another repeating unit. Examples of the repeating unit include an aliphatic alkylene, styrene, a vinyl derivative and a divalent group derived from acrlylamide.

The (meth)acrylic copolymer having the repeating units represented by the above-mentioned formulas (I), (II) and (III) which is employable in the present invention can be prepared by copolymerization reaction in the known method using a variety of monomers capable of giving such repeating units, for example, an acrylic acid, acrylic acid ester, methacrylic acid, methacrylic acid ester, acrylonitrile and methacrylonitrile, and other monomers copolymerizable with these monomers, if desired.

The (meth)acrylic copolymer employed in the present invention may be cross-linked with a crosslinking agent. Examples of the crosslinking agent include an aliphatic polyisocyanate and an aromatic polyisocyanate.

The (meth)acrylic copolymer is contained in the binder of the phosphor layer in the amount of 5–100% by weight. From the viewpoint of the dispersibility of phoshor particles in the binder solution, the easiness of uniform coating and the hardness of layer to be formed, the binder of the phospor layer preferably contains the (meth)acrylic copolymer in the amount of 40–90% by weight, the remainder being one or more other binder components.

Examples of the other binder component employable in combination with the (meth)acrylic copolymer in the present invention include synthetic polymers such as polyester, polyurethane, polyisocyanate, cellulose derivates, polyalkyl methacrylate, cellulosic resins, amino resins and melamine resins. Among these binder components, preferred are polyester, nitrocellulose, polyalkyl methacrylate, and a mixture of nitrocellulose and polyisocyanate.

Specifically, a linear polyester is preferably employed in combination with the (meth)acrylic copolymer.

The linear polyester preferably employed in the present invention has a hydroxyl value in the range of 20–70% in terms of mg.KOH/g, and preferably is a saturated linear polyester having a low molecular weight in the range of $3\times10^3$–$10^4$.

The linear polyester can be obtained by polycondensation reaction of a dioxy compound (e.g., ethylene glycol, 1,3-propanediol, 1,4-butanediol, or 1,4-cyclohexane dimethanol) and a divalent basic acid (e.g., succinic acid, glutaric acid, adipic acid, terephthalic acid, or isophthalic acid), and the saturated linear polyester having a hydroxyl value of 20–70% can be obtained by selecting the molar ratio of starting materials and/or reaction condition, etc. Otherwise, the linear polyester can be obtained by polycondensation reaction of an oxy acid such as glycolic acid, lactic acid, malic acid, tartaric acid, citric acid, salicyclic acid, benzoic acid, gallic acid, mandelic acid, or tropic acid.

The linear polyester is employed in the content of not more than 40% by weight, preferably 10–40% by weight, of the mixture thereof in combination with the above-mentioned (meth)acrylic copolymer.

The mixture of the (meth)acrylic copolymer and linear polyester is contained in the binder of the phosphor layer in the amount of 60–100% by weight. From the viewpoint of the dispersibility of the phosphor particles in the binder solution, the easiness of uniform coating and the hardness of layer to be formed, the binder of the phosphor layer preferably contains this mixture in the amount of 75–95% by weight, the remainder being one or more other binder component.

As for the other binder component employable in combination with the mixture of the (meth)acrylic copolymer and linear polyester in the present invention, the aforementioned binder components can be employed. More concretely, there can be mentioned polyester (e.g., Vylon 530; available from Toyobo Co., Ltd.), polyurethane (e.g., Desmocoll 400 and Desmolac KL-5-2625; available from Sumitomo Bayer Urethane Co., Ltd.), vinyl acetate resin (e.g., Denka ASR CL-13; available from Denki Kagaku Kogyo K.K.), stylene resin (e.g., Piccolastic A-75; available from Esso Standard Oil Co.), polyisocyanate, cellulose derivatives, polyarkylmethacrylate (e.g., Almatex; available from Mitsui Toatsu Chemicals, Inc.), cellulosic resins, amino resins and melamine resins. Among these binder components, preferred are nitrocellulose, polyalkyl methacrylate.

The stimulable phosphor, as described hereinbefore, gives stimulated emission when excited with stimulating rays after exposure to a radiation. From the viewpoint of practical use, the stimulable phosphor is desired to give stimulated emission in the wavelength region of 300–500 nm when excited with stimulating rays in the wavelength region of 400–900 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8\leqq x\leqq 10$, and $M^{2+}O.xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5\leqq x\leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0<x+y\leqq 0.6$, and $xy\neq 0$, and a is a number satisfying the condition of $10^{-6}\leqq a\leqq 5\times10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0\leqq x\leqq 0.6$ and $0\leqq y\leqq 0.2$, respectively, as described in Japanese Patent Provisional Publication No. 55(1980)-12145;

$M^{II}FX.xA:yLn$, in which $M^{II}$ is at least one element selected from the group consisting of Ba, Ca, Sr, Mg, Zn, and Cd; A is at least one compound selected from the group consisting of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$ and $ThO_2$; Ln is at least one element selected from the group consisting of Eu, Tb, Ce, Tm, Dy, Pr, Ho, Nd, Yb, Er, Sm and Gd; X is at least one element selected from the group consisting of Cl, Br and I; and x and y are numbers satisfying the conditions of $5\times10^{-5}\leqq x\leqq0.5$ and $0<y\leqq0.2$, respectively, as described in Japanese Patent Provisional Publication No. 55(1980)-160078;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of Zr and Sc; and a, x, y and z are numbers satisfying the conditions of $0.5\leqq a\leqq1.25$, $0\leqq x\leqq1$, $10^{-6}\leqq y\leqq2\times10^{-1}$, and $0<z\leqq10^{-2}$, respectively, as described in Japanese Patent Provisional Publication No. 56(1981)-116777;

$(Ba_{1-x},M^{II}_x)F_2.aBaX_2:yEu,zB$, in which $M^{II}$ is at least one element selected from the group consisting of Be, Mg, Ca, Sr, Zn and Cd; X is at least one element selected from the group consisting of Cl, Br and I; and a, x, y and z are numbers satisfying the conditions of $0.5\leqq a\leqq1.25$, $0\leqq x\leqq1$, $10^{-6}\leqq y\leqq2\times10^{-1}$, and $0<z\leqq2\times10^{-1}$, respectively, as described in Japanese Patent Provisional Publication No. 57(1982)-23673;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of As and Si; and a, x, y and Z are numbers satisfying the conditions of $0.5\leqq a\leqq1.25$, $0\leqq x\leqq1$, $10^{-6}\leqq y\leqq2\times10^{-1}$, and $0<z\leqq5\times10^{-1}$, respectively, as described in Japanese Patent Provisional Publication No. 57(1982)-23675;

$M^{III}OX:xCe$, in which $M^{III}$ is at least one trivalent metal selected from the group consisting of Pr, Nd, Pm, Sm, Eu, Tb, Dy, Ho, Er, Tm, Yb, and Bi; X is at least one element selected from the group consisting of Cl and Br; and x is a number satisfying the condition of $0<x<0.1$, as described in Japanese Patent Provision Publication No. 58(1983)-69281;

$Ba_{1-x}M_{x/2}L_{x/2}FX:yEu^{2+}$, in which M is at least one alkali metal selected from the group consisting of Li, Na, K, Rb and Cs; L is at least one trivalent metal selected from the group consisting of Sc, Y, La, Ce, Pr, Nd, Pm, Sm, Gd, Tb, Dy, Ho, Er, Tm, Yb, Lu, Al, Ga, In and Tl; X is at least one halogen selected from the group consisting of Cl, Br and I; and x and y are numbers satisfying the conditions of $10^{-2}\leqq x\leqq0.5$ and $0<y\leqq0.1$, respectively, as described in Japanese Patent Provisional Publication No. 58(1983)-206678;

$BaFX.xA:yEu^{2+}$, in which X is at least one halogen selected from the group consisting of Cl, Br and I; A is at least one fired product of a tetrafluoroboric acid compound; and x and y are numbers satisfying the conditions of $10^{-6}\leqq x\leqq0.1$ and $0<y\leqq0.1$, respectively, as described in Japanese Patent Provisional Publication No. 59(1984)-27980;

$BaFX.xA:yEu^{2+}$, in which X is at least one halogen selected from the group consisting of Cl, Br, and I; A is at least one fired product of a hexafluoro compound selected from the group consisting of monovalent and divalent metal salts of hexafluoro silicic acid, hexafluoro titanic acid and hexafluoro zirconic acid; and x and y are numbers satisfying the conditions of $10^{-6}\leqq x\leqq0.1$ and $0<y\leqq0.1$, respectively, as described in Japanese Patent Provisional Publication No. 59(1984)-47289;

$BaFX.xNaX':aEu^{2+}$, in which each of X and X' is at least one halogen selected from the group consisting of Cl, Br and I; and x and a are numbers satisfying the conditions of $0<x\leqq2$ and $0<a\leqq0.2$, respectively, as described in Japanese Patent Provisional Publication No. 59(1984)-56479;

$M^{II}FX.xNaX':yEu^{2+}:zA$, in which $M^{II}$ is at least one alkaline earth metal selected from the group consisting of Ba, Sr and Ca; each of X and X' is at least one halogen selected from the group consisting of Cl, Br and I; A is at least one transition metal selected from the group consisting of V, Cr, Mn, Fe, Co and Ni; and x, y and z are numbers satisfying the conditions of $0<x\leqq2$, $0<y\leqq0.2$ and $0<z\leqq10^{-2}$, respectively, as described in Japanese Patent Provisional Publication No. 59(1984)-56480; and $M^{II}FX.aM^{I}X'.bM'^{II}X''_2.cM^{III}X'''_3.xA:yEu^{2+}$, in which $M^{II}$ is at least one alkaline earth metal selected from the group consisting of Ba, Sr and Ca; $M^{I}$ is at least one alkali metal selected from the group consisting of Li, Na, K, Rb and Cs; $M'^{II}$ is at least one divalent metal selected from the group consisting of Be and Mg; $M^{III}$ is at least one trivalent metal selected from the group consisting of Al, Ga, In and Tl; A is at least one metal oxide; X is at least one halogen selected from the group consisting of Cl, Br and I; each of X', X'' and X''' is at least one halogen selected from the group consisting of F, Cl, Br and I; a, b and c are numbers satisfying the conditions of $0\leqq a\leqq2$, $0\leqq b\leqq10^{-2}$, $0\leqq c\leqq10^{-2}$ and $a+b+c\geqq10^{-6}$; and x and y are numbers satisfying the conditions of $0<x\leqq0.5$ and $0<y\leqq0.2$, respectively, as described in Japanese Patent Application No. 57(1982)-184455.

The above-described stimulable phosphors are given by no means to restrict the stimulable phosphor employable in the present invention. Any other phosphor can be also employed, provided that the phosphor gives stimulated emission when excited with stimulating rays after exposure to a radiation.

The phosphor layer can be formed on the support, for instance, by the following procedure.

In the first place, stimulable phoshor particles and a binder are added to an appropriate solvent, and then they are mixed to prepare a coating dispersion of the phosphor particles homogeneously dispersed in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The mixing ratio of the binder to the stimulable phoshor in the coating dispersion can be determined according to the characteristics of the aimed radiation image storage panel and the nature of the phosphor employed. Generally, the ratio is within the range of from 1:1 to 1:100 (binder:phosphor, by weight), preferably from 1:8 to 1:50.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly onto the surface of a support to form a layer of the coating dispersion. The coating procedure can be carried out by a conventional method such as a method using a doctor blade, a roll coater or a knife coater.

After applying the coating dispersion onto the support, the coating dispersion is then heated slowly to dryness so as to complete the formation of the phoshor layer. The thickness of the phosphor layer varies depending upon the characteristics of the aimed radiation image storage panel, the nature of the phosphor, the ratio of the binder to the phosphor, etc. In general, the thickness of the phosphor layer is within a range of from 20 μm to 1 mm, and preferably within a range of from 50 to 500 μm.

The phosphor layer can be provided onto the support by the methods other than that given in the above. For instance, the phosphor layer is initially prepared on a sheet material such as a glass plate, a metal plate or a plastic sheet using the aforementioned coating dispersion and then thus prepared phosphor layer is superposed on the genuine support by pressing or using an adhesive agent.

The support material employed in the present invention can be selected from those employable for the radiogaphic intensifying screens in the conventional radiography or those employable for the known radiation image storage panel. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, one or more additional layers are occasionally provided between the support and the phosphor layer so as to enhance the bonding strength between the support and the phosphor layer, or to improve the sensitivity of the panel or the quality of an image provided thereby. For instance, a subbing layer or an adhesive layer may be provided by coating polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided on the support.

As described in Japanese Patent Provisional Publication No. 58(1983)-200200, the phosphor layer side surface of the support (or the surface of an adhesive layer, light-reflecting layer, or light-absorbing layer in the case where such layers provided on the phosphor layer) may be provided with protruded and depressed portions for enhancement of the sharpness of radiographic image.

On the surface of the phosphor layer, a transparent protective film is preferably provided to protect the phosphor layer from physical and chemical deterioration.

The protective film can be provided onto the phosphor layer by coating the surface of the phosphor layer with a solution of a transparent polymer such as a cellulose derivative (e.g., cellulose acetate or nitrocellulose), or a synthetic polymer (e.g., polymethyl methacrylate, polyvinyl butyral, polyvinyl formal, polycarbonate, polyvinyl acetate, or vinyl chloride-vinyl acetate copolymer), and drying the coated solution. Alternatively, the protective film can be provided onto the phosphor layer by beforehand preparing it from a polymer such as polyethylene terephthalate, polyethylene, polyvinylidene chloride or polyamide, followed by placing and fixing it onto the phosphor layer with an appropriate adhesive agent. The transparent protective film preferably has a thickness within a range of approx. 0.1 to 20 μm.

The radiation image storage panel of the present invention may be colored with a colorant to improve the sharpness of the image provided thereby as described in Japanese Patent Provisional Publication No. 55(1980)-163500 and No. 57(1982)-96300. For the same purpose, a white powder may be dispersed in the phosphor layer of the panel as described in Japanese Patent Provisional Publication No. 55(1980)-146447.

The following examples will illustrate the present invention, but these examples are by no means to restrict the invention. In the following examples, the term of "part" means "part by weight", unless otherwise specified.

EXAMPLE 1

To a mixture of a particulate divalent europium activated barium fluorobromide phosphor ($BaFBr:Eu^{2+}$) and an acrylic copolymer (trade name: Criscoat P-1018GS, available from Dainippon Ink & Chemicals Inc., Japan) having the following repeating units;

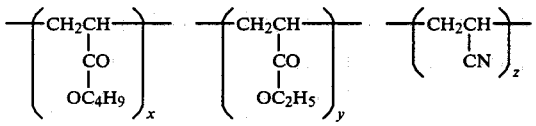

(in which x=60, y=30, and z=10) was added methyl ethyl ketone, and the mixture was sufficiently stirred by means of a propeller agitater to prepare a homogeneous coating dispersion having a mixing ratio of 1:25 (binder:phosphor, by weight) and a viscosity of 25–35 PS (at 25° C.).

Composition of the Coating Dispersion $BaFBr:Eu^{2+}$ phosphor: 500 parts
acrylic copolymer; 20 parts
methyl ethyl ketone: 110 parts Then the coating dispersion was evenly applied onto a polyethylene terephthalate film containing carbon black (support, thickness: 250 μm) placed horizontally on a glass plate. The application of the coating dispersion was carried out using a doctor blade. After the coating was complete, the support having a layer of the coating dispersion was heated to driness under air stream at 90° C. and at a flow rate of 1.0 m/sec. for 10 min. Thus, a phosphor layer having the thickness of approx. 250 μm was formed on the support.

On the phosphor layer was placed a polyethylene terephthalate transparent film (thickness: 12 μm; provided with a polyester adhesive layer on one surface) to combine the film and the phosphor layer with the adhesive layer. Thus, a radiation image storage panel consisting essentially of a support, a phosphor layer and a transparent protective film was prepared.

EXAMPLE 2

A radiation image storage panel consisting essentially of a support, a phosphor layer and a transparent protective film was prepared in the same manner as described in Example 1, except that aliphatic polyisocyanate (crosslinking agent; trade name: Sumidul N, available from Sumitomo Bayer Urethane Co., Ltd.), nitrocellulose (binder) and tricresyl phosphate (plasticizer) were added to the coating dispersion of Example 1, to prepare a coating dispersion having the following composition.

Composition of the Coating Dispersion $BaFBr:Eu^{2+}$ phosphor: 500 parts
acrylic copolymer: 16 parts
polyisocyanate: 1.0 part
nitrocellulose: 2.5 parts
tricresyl phosphate: 0.5 part
methyl ethyl ketone: 95 parts

EXAMPLE 3

A radiation image storage panel consisting essentially of a support, a phosphor layer and a transparent protective film was prepared in the same manner as described in Example 1, except that aliphatic polyisocyanate (crosslinking agent; trade name: Sumidul N, available from Sumitomo Bayer Urethane Co., Ltd., Japan), polymethyl methacrylate (binder; trade name: BR-107, available from Mitsubishi Rayon Co., Ltd., Japan), nitrocellulose (binder) and tricresyl phosphate (plasticizer) were added to the coating dispersion of Example 1 to prepare a coating dispersion having the following composition.

Composition of the Coating Dispersion $BaFBr:Eu^{2+}$ phosphor: 500 parts
acrylic copolymer: 14 parts
polyisocyanate: 1.0 part
polymethyl methacrylate: 2.0 parts
nitrocellulose: 2.5 parts
tricresyl phosphate: 0.5 part
methyl ethyl ketone: 95 parts

COMPARISON EXAMPLE 1

A radiation image storage panel consisting essentially of a support, a phosphor layer and a transparent protective film was prepared in the same manner as described in Example 1, except that a linear polyester (trade name: Vylon 500, available by Toyobo Co., Ltd., Japan) having a hydroxyl value of 7–10% and a molecular weight of $2\times10^4$–$2.5\times10^4$ and nitrocellulose were employed as a binder instead of the acrylic copolymer, and that tolylene isocyanate (crosslinking agent), tricresyl phosphate (plasticizer) and n-butanol (solvent) were added to the coating dispersion of Example 1 to prepare a coating dispersion having the following composition.

Composition of the Coating Dispersion $BaFBr:Eu^{2+}$ phosphor: 500 parts
linear polyester: 17 parts
tolylene isocyanate: 0.8 part
nitrocellulose: 2.0 parts
tricresyl phosphate: 0.2 part
n-butanol; 5.7 parts
methyl ethyl ketone: 87 parts

COMPARISON EXAMPLE 2

A radiation image storage panel consisting essentially of a support, a phosphor layer and a transparent protective film was prepared in the same manner as described in Comparison Example 1, except for using a coating dispersion of the following composition in which the mixing ratio was adjusted to 1:15 (binder:phosphor, by weight).

Composition of the Coating Dispersion

BaFBr:$Eu^{2+}$ phosphor: 500 parts
linear polyester: 28.1 parts
tolylene isocyanate; 1.3 parts
nitrocellulose: 3.1 parts
tricresyl phosphate: 0.5 part
n-butanol; 5.7 parts
methyl ethyl ketone: 75 parts

COMPARISON EXAMPLE 3

A radiation image storage panel consisting essentially of a support, a phosphor layer and a transparent protective film was prepared in the same manner as described in Example 1, except that nitrocellulose was employed as a binder instead of the acrylic copolymer and that tricresyl phosphate (plasticizer) and n-butanol (solvent) were added to the coating dispersion of Example 1, to prepare a coating dispersion having the following composition and the mixing ratio of 1:15 (binder:phosphor, by weight).

Composition of the Coating Dispersion

BaFBr:$Eu^{2+}$ phosphor: 500 parts
nitrocellulose: 32 parts
tricresyl phosphate: 1.0 part
n-butanol: 5.7 parts
methyl ethyl ketone: 75 parts The radiation image storage panels prepared in Examples 1 to 3 and Comparison Examples 1 to 3 were evaluated on the sharpness of the image provided thereby and the bonding strength between the phosphor layer and support according to the following test.

(1) Sharpness of image

The radiation image storage panel was exposed to X-rays at voltage of 80 KVp through an MTF chart and subsequently scanned with an He-Ne laser beam (wavelength: 632.8 nm) to excite the phosphor particles contained in the panel. The light emitted by the phosphor layer of the panel was detected and converted to electric signals by means of a photosensor (a photomultiplier having spectral sensitivity of type S-5). The electric signals were reproduced by an image reproducing apparatus to obtain a radiation image of the MTF chart as a visible image on a displaying apparatus, and the modulation transfer function (MTF) value of the visible image was determined. The MTF value was given as a value (%) at the spatial frequency of 2 cycle/mm.

(2) Bonding strength between phosphor layer and support

The radiation image storage panel was out to give a test strip (specimen) having a width of 10 mm, and the test strip was given a notch along the interface between the phosphor layer and the support. In a tensile testing machine (Tensilon UTM-II-20 manufactured by Toyo Balodwin Co., Ltd., Japan), the support part and the part consisting of the phosphor layer and protective film of the so notched test strip were forced to separate from each other by pulling one part from another part at rectangular direction (peel angle: 90°) at a rate of 10 mm/min. The bonding strength was determined just when a 10-mm long phosphor layer portion was peeled from the support. The strength (peel strength) is expressed in terms of the force F (g./cm).

The results of the evaluation on the radiation image storage panels are set forth in Table 1.

TABLE 1

| | B:P (by weight) | Bonding Strength (g./cm) | Sharpness (%) |
|---|---|---|---|
| Example 1 | 1:25 | 370 | 34 |
| Example 2 | 1:25 | 460 | 34 |
| Example 3 | 1:25 | 400 | 33 |
| Com. Example 1 | 1:25 | 80 | 31 |
| Com. Example 2 | 1:15 | 250 | 28 |
| Com. Example 3 | 1:15 | 30 | 28 |

Notes:
B:P means a mixing ratio by weight of the binder (B) to the stimulable phosphor (P).

As is evident from the results set forth in Table 1, the radiation image storage panels according to the present invention (Examples 1 to 3) were prominently enhanced in the bonding strength between the phosphor layer and support through the phosphor particles were contained in the phosphor layer in the large amount, and provided the images of extremely high sharpness, as compared with the conventional radiation image storage panels (Comparison Examples 1 to 3).

EXAMPLE 4

A radiation image storage panel consisting essentially of a support, a phosphor layer and a transparent protective film was prepared in the same manner as described in Example 1, except that a mixture of an acrylic copolymer (trade name: Criscoat P-1018GS, available from Dainippon Ink & Chemicals Inc.) having the following repeating units;

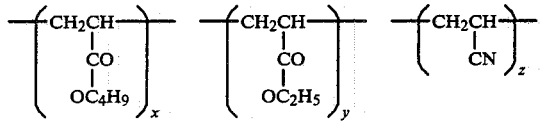

(in which x=60, y=30, and z=10) and a saturated linear polyester (trade name: Vylon GK-130, available from Toyobo Co., Ltd.) having a hydroxyl value of 30–60% and a molecular weight of $5\times10^3$–$8\times10^3$, and nitrocellulose were employed as a binder instead of the acrylic copolymer and that tricresyl phosphate (plasticizer) was added to the coating dispersion of Example 1, to prepare a coating dispersion having the following composition.

Composition of the Coating Dispersion

BaFBr:$Eu^{2+}$ phosphor: 500 parts
acrylic copolymer: 11 parts
saturated linear polyester: 7.0 parts
nitrocellulose: 1.6 parts
tricresyl phosphate: 0.4 part
methyl ethyl ketone: 110 parts (the content of the saturated linear polyester in the mixture of the acrylic copolymer and linear polyester: 39%)

EXAMPLE 5

A radiation image storage panel consisting essentially of a support, a phosphor layer and a transparent protective film was prepared in the same manner as described in Example 1, except that a mixture of an acrylic copolymer (trade name: Criscoat P-1018GS, available from Dainippon Ink & Chemicals Inc.) and a saturated linear polyester (trade name: Vylon GK-130, available from Toyobo Co., Ltd.), polymethyl methacrylate (trade name: BR-107, available by Mitsubishi Rayon Co., Ltd.) and nitrocellulose were employed as a binder instead of the acrylic copolymer and that tricresyl phosphate (plasticizer) was added to the coating dispersion of Example 1, to prepare a coating dispersion having the following composition.

Composition of the Coating Dispersion $BaFBr:Eu^{2+}$ phosphor: 500 parts
acrylic copolymer: 11.0 parts
saturated linear polyester: 5.4 parts
polymethyl methacrylate: 1.6 parts
nitrocellulose: 1.6 parts
tricresyl phosphate: 0.4 part
methyl ethyl ketone: 110 parts (the content of the saturated linear polyester in the mixture of the acrylic copolymer and linear polyester: 33%)

EXAMPLE 6

The radiation image storage panel consisting essentially of a support, a phosphor layer and a transparent protective film was prepared in the same manner as described in Example 1, except that polymethyl methacrylate (binder, trade name: Br-107, available from Mitsubishi Rayon Co., Ltd.), nitrocellulose (binder) and tricresyl phosphate (plasticizer) were added to the coating dispersion of Example 1, to prepare a coating dispersion having the following composition.

Composition of the Coating Dispersion $BaFBr:Eu^{2+}$ phosphor: 500 parts
acrylic copolymer: 11.0 parts
polymethyl methacrylate: 7.0 parts
nitrocellulose: 1.6 parts
tricresyl phosphate: 0.4 part
methyl ethyl ketone: 95 parts

EXAMPLE 7

A radiation image storage panel consisting essentially of a support, a phosphor layer and a transparent protective film was prepared in the same manner as described in Example 6, except for using a coating dispersion of the following composition.

Composition of the Coating Dispersion $BaFBr:Eu^{2+}$ phosphor: 500 parts
acrylic copolymer: 7.0 parts
polymethyl methacrylate: 11.0 parts
nitrocellulose: 1.6 parts
tricresyl phosphate: 0.4 part
methyl ethyl ketone: 95 parts

COMPARISON EXAMPLE 4

The radiation image storage panel consisting essentially of a support, a phosphor layer and a transparent protective film was prepared in the same manner as described in Example 4, except for using a coating dispersion of the following composition.

Composition of the Coating Dispersion $BaFBr:Eu^{2+}$ phosphor: 500 parts
acrylic copolymer: 7.0 parts
saturated linear polyester: 11.0 parts
nitrocellulose: 1.6 parts
tricresyl phosphate: 0.4 part
methyl ethyl ketone: 110 parts (the content of the saturated linear polyester in the mixture of the acrylic copolymer and linear polyester: 61%)

The prepared coating dispersion was turbid owing to the poor compatibility between the acrylic copolymer and linear polyester.

The radiation image storge panels prepared in Examples 4 to 7 and Comparison Example 4 was evaluated on the resistance to bending (i.e., flexing resistance) and the bonding strength between the phosphor layer and protective film according to the following test, as well as on the above-mentioned sharpness of the image and the bonding strength between the phosphor layer and support.

(1) Flexing Resistance

The radiation image storage panel was cut to give a test strip (specimen) having a width of 100 mm and the test strip was wound round a variety of cylinders whose diameters range from 40 to 145 mm for a certain period of time. The flexing resistance was evaluated through eye observation on the crack occurring in the phosphor layer of the test strip.

(2) Bonding strength between phosphor layer and protective film

The radiation image storage panel was cut to give a test strip (specimen) having a width of 10 mm and the test strip was given with a notch along the interface between the phosphor layer and the protective film. The bonding strength between the phosphor layer and protective film was determined in the same manner as described for the bonding strength between the phosphor layer and support.

The results of the evaluation on the radiation image storage panels are set forth in Table 2.

TABLE 2

| | Bonding Strength (g./cm) | | Crack | Sharpness |
|---|---|---|---|---|
| | protective film | support | (cylinder) | (%) |
| Ex. 4 | 148–162 | 440 | Not occurred (40 mm) | 33 |
| Ex. 5 | 92–99 | 430 | Not occurred (40 mm) | 33 |
| Ex. 6 | 76–84 | 360 | Not occurred (40 mm) | 34 |
| Ex. 7 | 102–125 | 320 | Occurred (145 mm) | 33 |
| Com. Ex. 4 | 147–157 | 400 | Not occurred (40 mm) | 32 |

As is evident from the results set forth in Table 2, the radiation image storage panels according to the present invention in which the binder of the phosphor layer comprised the mixture of acrylic copolymer and saturated linear polyester (Examples 4 and 5) were enhanced in the bonding strength between the phosphor layer and protective film as well as that between the phosphor layer and support, as compared with another panel according to the present invention in which the binder comprised the acrylic copolymer (Example 6).

Further, the radiation image storage panels (Examples 4 and 5) were enhanced in the resistance to bending as well as the bonding strength between the phosphor layer and support, as compared with another panel according to the present invention (Example 7), and provided the images of high sharpness.

In contrast, although the radiation image storage panel (Comparison Example 4) showed the high bonding strength and the high resistance to bending, the compatibility of the binder components is poor and the gathering on surface of the binder was observed in the phosphor layer owing to the phase separation thereof, to decrease the sharpness of the image provided by the panel.

We claim:

1. A radiation image storage panel comprising a support and a phosphor layer provided thereon which comprises a binder and a stimulable phosphor dispersed therein, characterized in that said binder contains a (meth)acrylic copolymer in the amount of 5–100% by weight, which has repeating units represented by the formulas (I), (II) and (III):

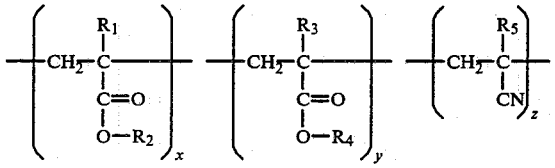

(I) (II) (III)

in which each of $R_1$, $R_3$ and $R_5$ is independently a hydrogen atom or an alkyl group; $R_2$ is a group selected from those consisting of an alkyl group, a cycloalkyl group, an aryl group, a heterocyclic group and an aralkyl group; $R_4$ is a hydrogen atom or an alkyl group and $R_2 \neq R_4$; and x, y and z representing molar percents are numbers satisfying the conditions of $5 \leqq x \leqq 99$, $1 \leqq y+z \leqq 95$ and $x+y+z \geqq 90$.

2. The radiation image storage panel as claimed in claim 1, in which x, y and z in the formulas (I), (II) and (III) are numbers satisfying the conditions of $50 \leqq x \leqq 95$, $5 \leqq y+z \leqq 50$ and $x+y+z \geqq 95$, and said binder contains the (meth)acrylic copolymer in the amount of 40–90% by weight.

3. The radiation image storage panel as claimed in claim 2, in which x, y and z in the formulas (I), (II) and (III) are numbers satisfying the conditions of $70 \leqq x \leqq 95$, $y=0$, $5 \leqq z \leqq 30$ and $x+y+z \geqq 95$.

4. The radiation image storage panel as claimed in claim 2, in which x, y and z in the formulas (I), (II) and (III) are numbers satisfying the conditions of $x+y+z=100$.

5. The radiation image storage panel as claimed in claim 1, in which said (meth)acrylic copolymer is crosslinked with a crosslinking agent.

6. The radiation image storage panel as claimed in claim 5, in which said crosslinking agent is polyisocyanate.

7. The radiation image storage panel as claimed in any one of claims 1 through 6, in which said stimulable phosphor is a divalent europium activated alkaline earth metal fluorohalide phosphor.

8. A radiation image storage panel comprising a support, a phosphor layer which comprises a binder and a stimulable phosphor dispersed therein, and a protective film, superposed in this order, characterized in that said binder contains a mixture of a (meth)acrylic copolymer having repeating units represented by the formulas (I), (II) and (III) and a linear polyester having a hydroxyl value in the range of 20–70% whose content is not more than 40% by weight of said mixture, in the amount of 60–100% by weight:

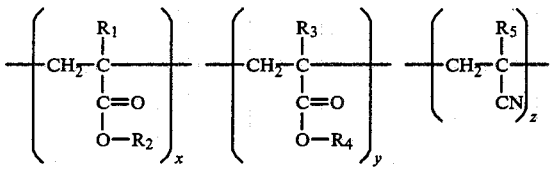

(I) (II) (III)

in which each of $R_1$, Rhd 3 and $R_5$ is independently a hydrogen atom or an alkyl group; $R_2$ is a group selected from those consisting of an alkyl group, a cycloalkyl group, an aryl group, a heterocyclic group and an aralkyl group; $R_4$ is a hydrogen atom or an alkyl group and $R_2 \neq R_4$; and x, y and z representing molar percents are numbers satisfying the conditions of $5 \leqq x \leqq 99$, $1 \leqq y+z \leqq 95$ and $x+y+z \geqq 90$.

9. The radiation image storage panel as claimed in claim 8, in which said linear polyester has a molecular weight in the range of $3 \times 10^3$–$10^4$.

10. The radiation image storage panel as claimed in claim 8, in which said binder contains the mixture of (meth)acrylic copolymer and linear polyester in the amount of 75–95% by weight.

11. The radiation image storage panel as claimed in claim 8, in which the content of said linear polyester is in the range of 10–40% by weight of the mixture.

12. The radiation image storage panel as claimed in any one of claims 8 through 11, in which said stimulable phosphor is a divalent europium activated alkaline earth metal fluorohalide phosphor.

* * * * *